US011199793B2

(12) United States Patent
Shirayanagi

(10) Patent No.: US 11,199,793 B2
(45) Date of Patent: Dec. 14, 2021

(54) DEVELOPING APPARATUS

(71) Applicant: CANON KABUSHIKI KAISHA, Tokyo (JP)

(72) Inventor: Jun Shirayanagi, Ushiku (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/891,162

(22) Filed: Jun. 3, 2020

(65) Prior Publication Data

US 2020/0387084 A1 Dec. 10, 2020

(30) Foreign Application Priority Data

Jun. 6, 2019 (JP) ..... JP2019-106040
Jun. 6, 2019 (JP) ..... JP2019-106041

(51) Int. Cl.
*G03G 15/08* (2006.01)

(52) U.S. Cl.
CPC ..... *G03G 15/0889* (2013.01); *G03G 15/0891* (2013.01)

(58) Field of Classification Search
CPC ..... G03G 15/0887; G03G 15/0889; G03G 15/0891; G03G 15/0893; G03G 2215/0802; G03G 2215/0816; G03G 2215/0819; G03G 2215/0822; G03G 2215/0833; G03G 2215/0836; G03G 2215/0838
See application file for complete search history.

(56) References Cited

U.S. PATENT DOCUMENTS 6,275,674 B1 * 8/2001 Sugimoto ..... G03G 15/0822 399/254
6,834,175 B2 12/2004 Murayama et al.
9,841,704 B2 12/2017 Matsumoto et al.
10,353,319 B2 7/2019 Tsuda

FOREIGN PATENT DOCUMENTS

JP 2003-270947 A 9/2003
JP 2004-272295 A 9/2004
JP 2012-234153 A 11/2012
JP 2019-028314 A 2/2019

* cited by examiner

*Primary Examiner* — Thomas S Giampaolo, II
(74) *Attorney, Agent, or Firm* — Venable LLP

(57) ABSTRACT

A developing apparatus includes a developer bearing member, a first conveyance screw arranged in a first chamber to convey developer in a first direction, and a second conveyance screw arranged in a second chamber convey the developer in an opposite second direction. A toner density detector is arranged in the second chamber to detect toner density of the developer in a circulation path. The second conveyance screw includes a first blade portion having a helical shape, a second blade portion having a helical shape of a same turn direction as the first blade portion, a gap portion provided between the first and second blade portions, and a plurality of agitating portions provided in the gap portion. Each of the agitating portions has a wall portion provided to intersect a rotational axis direction of the second conveyance screw and a recessed portion having a shape in which a portion of a periphery of the wall portion is recessed.

10 Claims, 9 Drawing Sheets

DEVELOPING APPARATUS

BACKGROUND OF THE INVENTION

Field of the Invention

The present invention relates to a developing apparatus applied to an image forming apparatus adopting an electrophotographic system or an electrostatic recording system.

Description of the Related Art

Hitherto, image forming apparatuses adopting an electrophotographic system or an electrostatic recording system are widely applied as copying machines, printers, facsimiles and multifunction devices having a plurality of such functions. In general, developing apparatuses provided in the image forming apparatuses adopting the electrophotographic system or the electrostatic recording system use either a one-component developer containing magnetic toner as a main component or a two-component developer containing non-magnetic toner and magnetic carrier as main components. Especially in image forming apparatuses that form full-color or multi-color images using electrophotographic systems, two-component developer is used in most developing apparatuses from the viewpoint of image tone and the like.

An agitating member for sufficiently agitating replenished toner and carrier has been developed for such developing apparatus using two-component developer. For example, a configuration for improving agitating efficiency is known, which provides an agitation rib serving as an agitating member arranged in a conveyance direction along a conveyance screw configured to convey developer inside a developer container of the developing apparatus (refer to Japanese Patent Application Laid-Open No. 2003-270947).

Along with the recent trend of downsizing of the image forming apparatus, the amount of developer stored in the developing apparatus has been reduced. Further, the speed of the image forming process in the image forming apparatus has been increased, and along therewith, the amount of replenishment of toner being replenished per unit time is also increased. Therefore, replenished toner must be agitated more speedily in a short time to the small amount of developer in the developing apparatus compared to the conventional apparatus.

The developing apparatus according to Japanese Patent Application Laid-Open No. 2003-270947 has the agitation rib arranged along the conveyance direction on the conveyance screw, so that if there is only a small amount of toner being conveyed, the toner will easily passes through the area where the agitation rib is provided, and the agitating property would be insufficient. Therefore, even if it was desirable to agitate replenished toner speedily to the small amount of developer, the developing apparatus disclosed in Japanese Patent Application Laid-Open No. 2003-270947 did not allow toner to be agitated sufficiently, so that the quality of an image being formed may be deteriorated.

The present invention provides a developing apparatus capable of realizing a high agitating property with the conveying property maintained even in a case where there is small amount of developer.

SUMMARY OF THE INVENTION

According to a first aspect of the present invention, a developing apparatus includes a developer bearing member configured to bear developer containing toner and carrier and to rotate, a first chamber configured to supply the developer to the developer bearing member, a second chamber defined by a partition wall from the first chamber and configured to form a circulation path of the developer with the first chamber, a first conveyance screw arranged in the first chamber and configured to convey the developer in a first direction, a second conveyance screw arranged in the second chamber and configured to convey the developer in a second direction opposite to the first direction, a first communication portion configured to allow the developer to communicate from the second chamber to the first chamber, and a second communication portion provided upstream of the first communication portion in the second direction and configured to allow the developer to communicate from the first chamber to the second chamber. The second conveyance screw comprises a first blade portion having a helical shape, a second blade portion provided downstream of the first blade portion in the second direction and having a helical shape of a same turn direction as the first blade portion, a gap portion provided between the first blade portion and the second blade portion in the second direction, and a plurality of agitating portions provided in the gap portion. Each of the plurality of agitating portions comprises a wall portion provided to intersect a rotational axis direction of the second conveyance screw and a recessed portion having a shape in which a portion of a periphery of the wall portion is recessed. The plurality of agitating portions is arranged downstream in the second direction of an upstream end portion of the second communication portion in the second direction and arranged upstream in the second direction of a downstream end portion of the first communication portion in the second direction.

According to a second aspect of the present invention, a developing apparatus includes a developer bearing member configured to bear developer containing toner and carrier and to rotate, a first chamber configured to supply the developer to the developer bearing member, a second chamber defined by a partition wall from the first chamber and configured to form a circulation path of the developer with the first chamber, a first conveyance screw arranged in the first chamber and configured to convey the developer in a first direction, a second conveyance screw arranged in the second chamber and configured to convey the developer in a second direction opposite to the first direction, a first communication portion configured to allow the developer to communicate from the second chamber to the first chamber, and a second communication portion provided upstream of the first communication portion in the second direction and configured to allow the developer to communicate from the first chamber to the second chamber. The second conveyance screw comprises a first blade portion having a helical shape, a second blade portion provided downstream of the first blade portion in the second direction and having a helical shape of a same turn direction as the first blade portion, a third blade portion provided between the first blade portion and the second blade portion and having a helical shape of the same turn direction as the first and second blade portions with a pitch narrower than the first and second blade portions, and a recessed portion having a shape in which a portion of a periphery of the third blade portion is recessed. The third blade portion is arranged downstream in the second direction of an upstream end portion of the second communication portion in the second direction and arranged upstream in the second direction of a downstream end portion of the first communication portion in the second direction.

According to a third aspect of the present invention, a developing apparatus includes a developer bearing member configured to bear developer containing toner and carrier and to rotate, a first chamber configured to supply the developer to the developer bearing member, a second chamber defined by a partition wall from the first chamber and configured to form a circulation path of the developer with the first chamber, a first conveyance screw arranged in the first chamber and configured to convey the developer in a first direction, a second conveyance screw arranged in the second chamber and configured to convey the developer in a second direction opposite to the first direction, a first communication portion configured to allow the developer to communicate from the second chamber to the first chamber, and a second communication portion provided upstream of the first communication portion in the second direction and configured to allow the developer to communicate from the first chamber to the second chamber. The second conveyance screw comprises a first blade portion having a helical shape, a second blade portion having a helical shape of a same turn direction as the first blade portion, a third blade portion provided between the first blade portion and the second blade portion and having a helical shape of an opposite turn direction as the first and second blade portions, and a recessed portion comprising a shape in which a portion of a periphery of the third blade portion is recessed. The third blade portion is arranged downstream in the second direction of an upstream end portion of the second communication portion in the second direction and arranged upstream in the second direction of a downstream end portion of the first communication portion in the second direction.

Further features of the present invention will become apparent from the following description of exemplary embodiments with reference to the attached drawings.

DESCRIPTION OF THE EMBODIMENTS

First Embodiment

Figure 1:
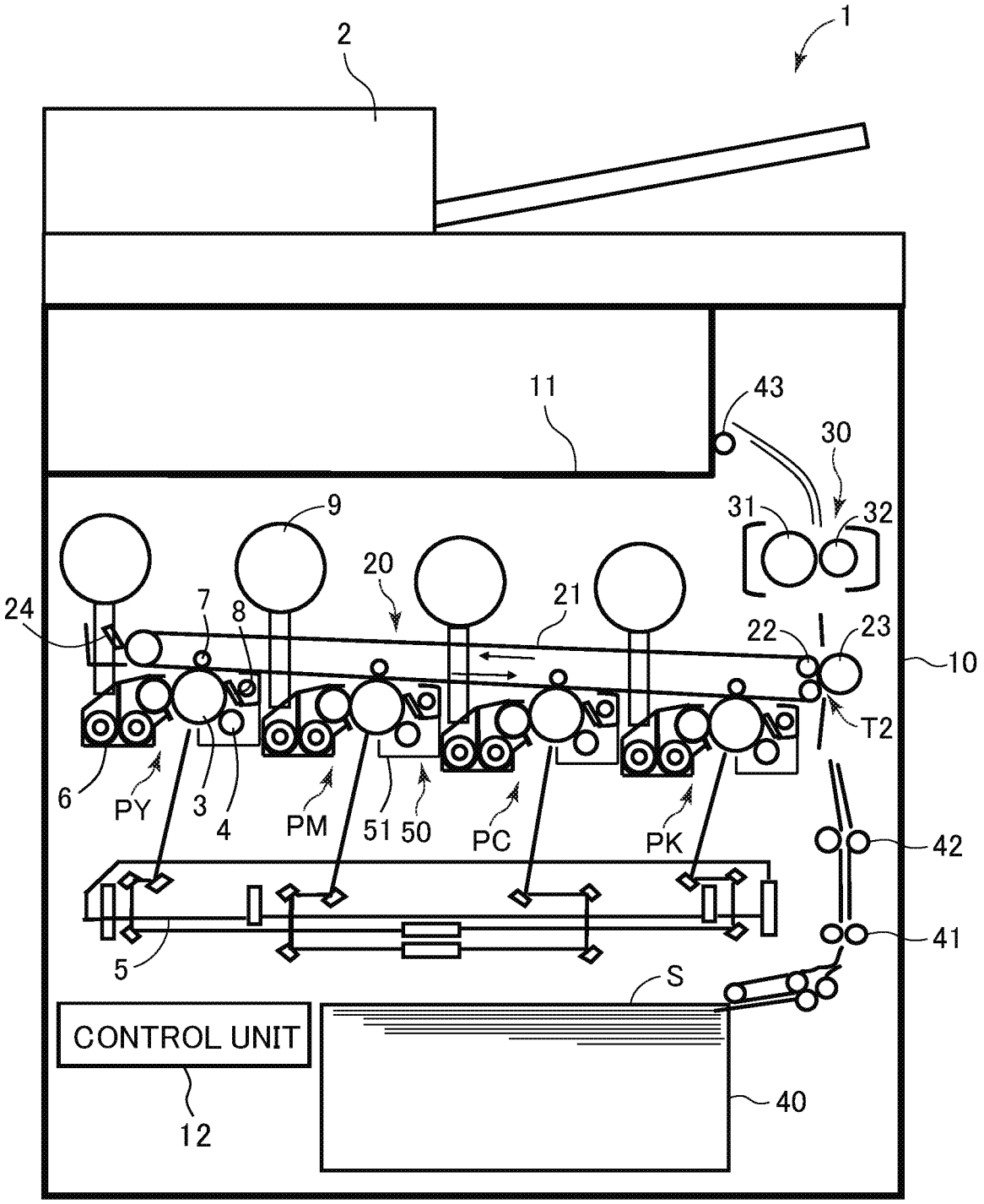
FIG. 1 is a cross-sectional view of an image forming apparatus according to a first embodiment.

Now, a first embodiment of the present disclosure will be described in detail with reference to FIGS. 1 to 5. At first, a general configuration of an image forming apparatus according to the present disclosure will be described with reference to FIG. 1.

Image Forming Apparatus

An image forming apparatus 1 according to the present embodiment is a tandem-type full-color printer adopting an electrophotographic system including four image forming units PY, PM, PC and PK each including a photosensitive drum 3 serving as an image bearing member. The image forming apparatus 1 forms a toner image corresponding to an image signal from a document reading apparatus 2 connected to an apparatus body 10 or an image signal from a host device such as a personal computer connected in a manner capable of communicating with the apparatus body 10 on a recording material. A sheet material (hereinafter abbreviated as sheet) including paper, plastic film and cloth can be used as the recording material. The image forming units PY, PM, PC and PK respectively form toner images of yellow, magenta, cyan and black.

The four image forming units PY, PM, PC and PK provided in the image forming apparatus 1 adopt approximately the same configuration except for the difference in the imaging color. Therefore, the image forming unit PY will be described here as an example, and description of other image forming units will be omitted.

The image forming apparatus 1 includes a control unit 12. The control unit 12 is configured of a computer, and includes, for example, a CPU, a ROM for storing a program controlling various units, a RAM for temporarily storing data, and an input/output circuit for inputting/outputting signals from/to an exterior. The CPU is a microprocessor that administrates the overall control of the image forming apparatus 1, and it is a main constituent of a system controller. The CPU is connected via the input/output circuit to units such as the sheet feeding unit, the image forming units PY, PM, PC and PK and the sheet conveyance unit, communicating signals with respective units and controlling operations thereof.

Image Forming Unit

The image forming unit PY includes a photosensitive drum 3, a charging roller 4, an exposing unit 5, a developing apparatus 6, a primary transfer roller 7 and a cleaning blade 8. The photosensitive drum 3 and the charging roller 4 are supported rotatably on a drum container 51, and the charging roller 4 and the cleaning blade 8 are supported in a manner pressed against the photosensitive drum 3. The photosensitive drum 3, the charging roller 4, the cleaning blade 8 and the drum container 51 constitute a drum cartridge 50 and are detachably attached to the apparatus body 10.

The photosensitive drum 3 serving as a rotatable image bearing member is a cylindrical, or drum-shaped, electrophotographic photosensitive member including a photosensitive layer serving as an organic optical semiconductor having negative charging characteristics. The photosensitive drum 3 has a diameter of 30 mm and a longitudinal length of 360 mm, connected in a drivable manner to a driving source not shown installed in the apparatus body 10, and rotated by driving force of the driving source by a process speed, i.e., peripheral speed, of 250 mm/sec. The charging roller 4 is pressed by the photosensitive drum 3 and driven to rotate by rotation of the photosensitive drum 3. A laser beam scanner equipped with a semiconductor laser for irradiating laser beams to the photosensitive drum 3 charged by the charging roller 4 is adopted as the exposing unit 5.

A transfer device 20 is arranged above the image forming units PY, PM, PC and PK. In the transfer device 20, an endless intermediate transfer belt 21 is tensioned by a plurality of rollers and configured to be moved in circulating motion, i.e., rotated, in the arrow direction. The intermediate transfer belt 21 is interposed between the photosensitive drum 3 and the primary transfer roller 7 is provided. The intermediate transfer belt 21 bears and conveys a toner image primarily transferred to the intermediate transfer belt 21. A secondary transfer outer roller 23 is arranged at a position interposing the intermediate transfer belt 21 and opposed to a secondary transfer inner roller 22 among the rollers tensioning the intermediate transfer belt 21, constituting a secondary transfer portion T2 where the toner image on the intermediate transfer belt 21 is transferred to a sheet S. A fixing unit 30 is arranged downstream of the secondary transfer portion T2 in a sheet conveyance direction. A storage container 9 for replenishing developer to the developing apparatus 6 is arranged above the transfer device 20.

A cassette 40 in which sheets S are stored is arranged at a lower portion of the image forming apparatus 1. The sheet S fed from the cassette 40 is conveyed via a conveyance roller 41 toward a registration roller 42. A leading edge of the sheet S abuts against the registration roller 42 in a stopped state and the sheet S forms a loop, by which skewing of the sheet S is corrected. Thereafter, rotation of the registration roller 42 is started in synchronization with the toner image on the intermediate transfer belt 21, and the sheet S is conveyed to the secondary transfer portion T2.

A process for forming a full-color image of four colors will be described with reference to the image forming apparatus 1 configured as above. At first, in a state where an image forming operation is started, the surface of the rotating photosensitive drum 3 is charged uniformly by the charging roller 4. Next, the photosensitive drum 3 is exposed by laser beams corresponding to image signals emitted from the exposing unit 5, and an electrostatic image corresponding to the image signal is formed on the photosensitive drum 3. The electrostatic image formed on the photosensitive drum 3 is developed by toner serving as developer stored in the developing apparatus 6 and visualized.

The toner image formed on the photosensitive drum 3 is primarily transferred to the intermediate transfer belt 21 at a primary transfer portion T1 (refer to FIG. 2) formed between the photosensitive drum 3 and the intermediate transfer belt 21. In this state, a primary transfer bias is applied to the primary transfer roller 7. Transfer residual toner remaining on the surface of the photosensitive drum 3 after primary transfer is removed by the cleaning blade 8.

This operation is performed sequentially for each of the image forming units PY, PM, PC and PK corresponding to yellow, magenta, cyan and black, and toner images of four colors sequentially are superposed on the intermediate transfer belt 21. Thereafter, the sheet S stored in the cassette 40 is conveyed to the secondary transfer portion T2 at a matched timing with the formation of the toner image. Thereafter, by applying a secondary transfer bias to the secondary transfer outer roller 23, the toner images of four colors on the intermediate transfer belt 21 are collectively secondarily transferred to the sheet S. Toner remaining on the intermediate transfer belt 21 without being transferred at the secondary transfer portion T2 is removed by an intermediate transfer belt cleaner 24.

Next, the sheet S is conveyed to the fixing unit 30. The fixing unit 30 includes a fixing roller 31 having a heat source such as a halogen heater provided therein and a pressure roller 32, and the fixing roller 31 together with the pressure roller 32 forms a fixing nip portion. The sheet S onto which toner image has been transferred is passed through the fixing nip portion of the fixing unit 30 by which the sheet S is heated and pressed. Then, toner on the sheet S is melted and mixed and fixed onto the sheet S as a full-color image. Thereafter, the sheet S is discharged by a sheet discharge roller 43 to a sheet discharge tray 11. Thereby, the series of image forming processes is ended.

The image forming apparatus 1 according to the present embodiment can form a mono-color image, i.e., the black image, using one image forming unit, or a multi-color image using image forming units of several of the four colors.

Developing Apparatus

Next, a detailed configuration of the developing apparatus 6 will be described with reference to FIGS. 2 and 3. In the present embodiment, the developing apparatus 6 is cartridge-shaped and constitutes a developer cartridge. The developing apparatus 6 includes a developer container 60 storing developer containing nonmagnetic toner and magnetic carrier, and a developing sleeve, i.e., developer bearing member, 70 which is a cylindrical rotator that bears developer in the developer container 60 and rotates. The developing sleeve 70 is stored in the developer container 60 with a gap G formed between the photosensitive drum 3, and the developing sleeve 70 bears developer stored in the developer container 60 and conveys developer to a development area Ar opposed to the photosensitive drum 3 to develop the electrostatic latent image.

Figure 2:
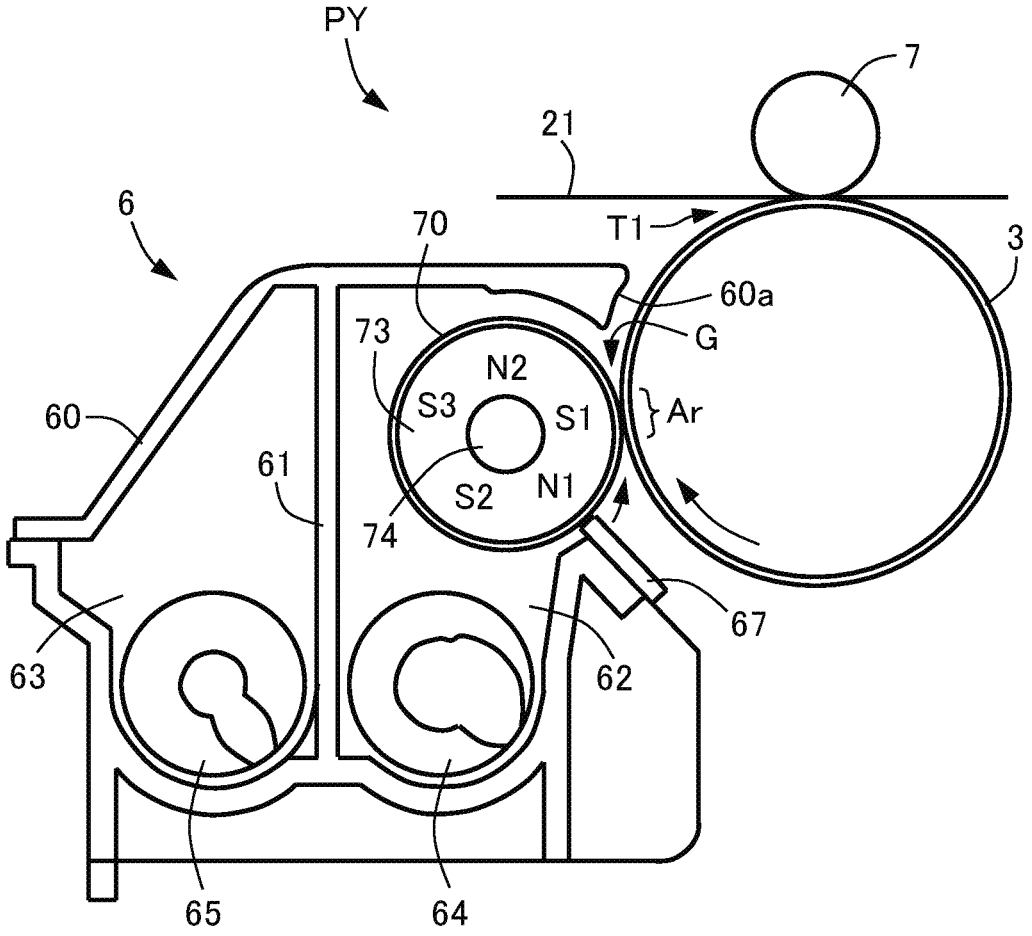
FIG. 2 is a cross-sectional view of a developing apparatus according to the first embodiment.
Figure 3:
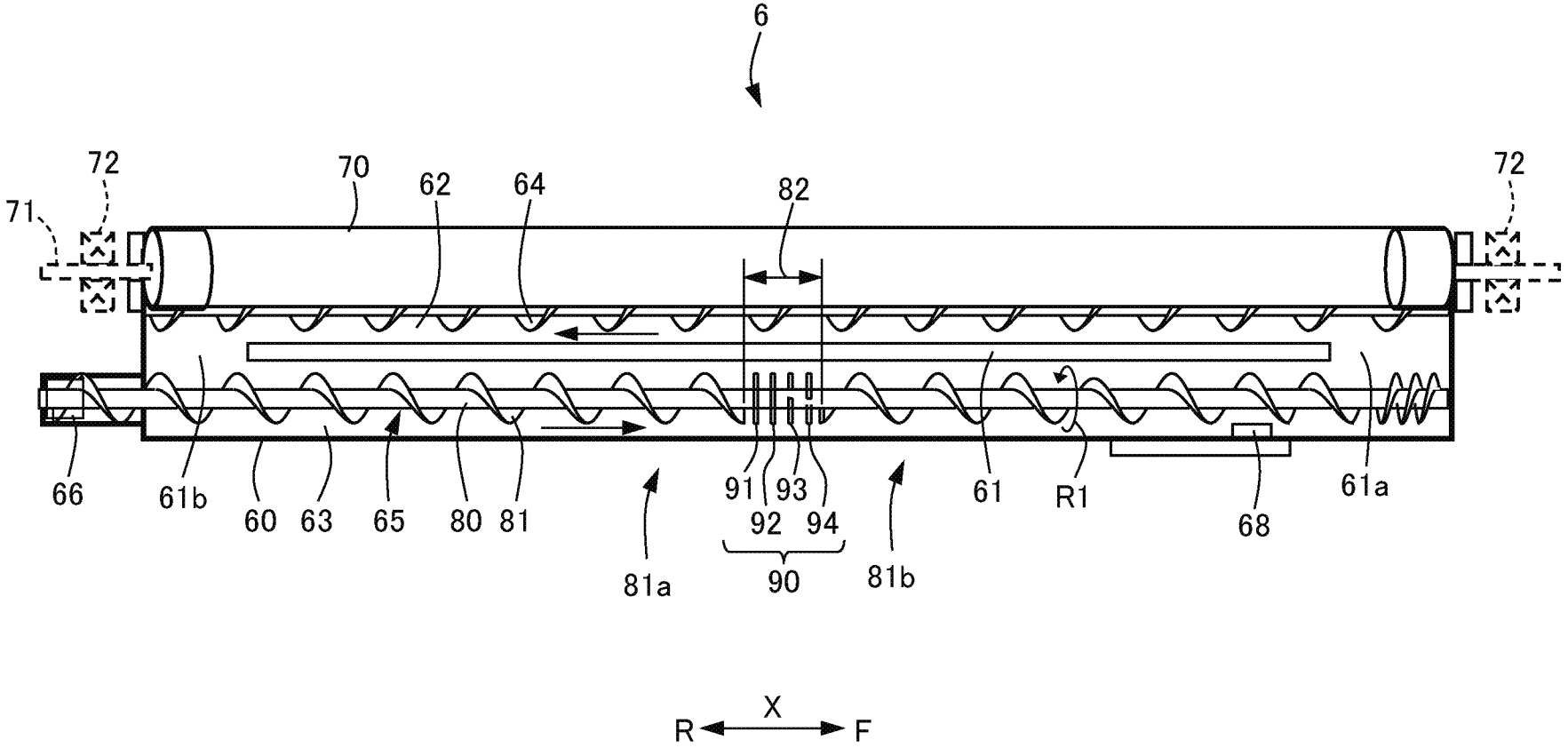
FIG. 3 is a vertical cross-sectional view of the developing apparatus according to the first embodiment.

As illustrated in FIG. 3, the developing sleeve 70 has a center shaft 71, the center shaft 71 being supported by a sleeve bearing 72 that supports the center shaft 71 rotatably with respect to the developer container 60 and driven to rotate in the direction of the arrow in FIG. 2. In the present specification, a rotational axis direction of the developing sleeve 70 is indicated as a longitudinal direction, i.e., width direction, X, a front direction of the apparatus body 10 in the longitudinal direction X is indicated as a front direction F, and a depth direction thereof is indicated as a rear direction R.

As illustrated in FIG. 2, a magnet roller 73 serving as a developing magnet having a plurality of magnetic poles arranged in the circumferential direction is provided non-rotatably with respect to the developer container 60 by a magnet support shaft 74 in the inner side of the developing sleeve 70. A center portion of an inside of the developer container 60 is defined by a partition wall 61 which is arranged to extend in the rotational axis direction of the developing sleeve 70 into a developing chamber, i.e., first chamber, 62 and an agitating chamber, i.e., second chamber, 63 arranged on left and right sides in the horizontal direction. Developer is stored in the developing chamber 62 and the agitating chamber 63 partitioned by the partition wall 61. The developing chamber 62 and the agitating chamber 63 constitute a circulation path of developer. A first conveyance screw 64 is arranged in the developing chamber 62 and a second conveyance screw 65 is arranged in the agitating chamber 63. The first conveyance screw 64 and the second conveyance screw 65 serving as agitating members are arranged approximately in parallel along the rotational axis direction of the developing sleeve 70, agitating and conveying developer in the developer container 60 and circulating the developer in the developer container 60. A first communicating port 61*a* serving as an example of a first communication portion and a second communicating port 61*b* serving as an example of a second communication portion that allow developer to pass to/from the developing chamber 62 from/to the agitating chamber 63 are provided at both end portions, that is, left and right sides of FIG. 3, in the longitudinal direction X of the partition wall 61.

The first conveyance screw 64 and the second conveyance screw 65 are both screw-shaped members, each having a helical blade provided around the rotation shaft. The first conveyance screw 64 is arranged on a bottom portion of the developing chamber 62 along the longitudinal direction X of the developing sleeve 70, agitating and conveying developer in the developing chamber 62 along the rotational axis direction and supplying developer to the developing sleeve 70 by having the rotation shaft rotated by a driving source. Developer borne on the developing sleeve 70 and having its toner consumed by the image developing step is collected in the developing chamber 62. The first conveyance screw 64 conveys developer to the rear direction R corresponding to a first direction.

The second conveyance screw 65 is arranged at the bottom portion in the agitating chamber 63 along the longitudinal direction X of the developing sleeve 70, agitating and conveying developer in the agitating chamber 63 along the rotational axis direction to an opposite direction as the first conveyance screw 64 and uniformizing toner density. The second conveyance screw 65 conveys developer toward a front direction F which is a second direction opposite to the rear direction R. The partition wall 61 includes the first communicating port 61*a* allowing developer to communicate from the agitating chamber 63 to the developing chamber 62 and the second communicating port 61*b* provided upstream of the first communicating port 61*a* in the front direction F and allowing developer to communicate from the developing chamber 62 to the agitating chamber 63. Developer is conveyed by the first conveyance screw 64 and the second conveyance screw 65, passed through the first communicating port 61*a* and the second communicating port 61*b* and circulated in the developer container 60.

A developer replenishment port 66 for replenishing developer containing toner into the developer container 60 is provided at an upstream end portion of the agitating chamber 63 in a developer conveyance direction of the second conveyance screw 65. The developer replenishment port 66 is connected via a developer replenishment device not shown to the storage container 9 (refer to FIG. 1). Therefore, developer for replenishment is supplied from the storage container 9 via the developer replenishment device and the developer replenishment port 66 to the agitating chamber 63. The second conveyance screw 65 agitates and conveys the developer replenished through the developer replenishment port 66 and the developer already present in the agitating chamber 63 and uniformizes the toner density.

Therefore, as illustrated in FIG. 3, the developer in the developing chamber 62 whose toner has been consumed in the developing process and having a lower toner density is passed through the first communicating port 61*a* at a side in the rear direction R and moves to the agitating chamber 63 by conveyance force of the first conveyance screw 64 and the second conveyance screw 65. Then, the developer having moved to the agitating chamber 63 is agitated and conveyed with the replenished developer and conveyed to pass through the second communicating port 61*b* at a side in the front direction F into the developing chamber 62.

As illustrated in FIG. 2, an opening portion 60*a* is arranged at a position corresponding to the development area Ar opposed to the photosensitive drum 3 in the developing chamber 62 of the developer container 60, and the developing sleeve 70 is arranged rotatably with one portion thereof exposed through the opening portion 60*a* toward the direction of the photosensitive drum 3. The developing sleeve 70 is driven to rotate by a driving source to convey developer to the development area Ar and supply developer to the photosensitive drum 3 at the development area Ar. In the present embodiment, the developing sleeve 70 is formed in a cylindrical shape using aluminum or stainless steel serving as nonmagnetic material, having a diameter of 20 mm and a longitudinal length of 334 mm and rotated at a processing speed, i.e., peripheral speed, of 250 mm/sec during image developing operation.

A developer blade 67 that regulates an amount, i.e., layer thickness, of developer borne on the developer sleeve 70 is fixed an upstream side of the opening portion 60*a* in the direction of rotation of the developing sleeve 70. The developer blade 67 forms a thin layer of developer on the surface of the developing sleeve 70.

The magnet roller 73 is formed in the shape of a roller having a plurality of, that is, a total of five, magnetic poles S1, S2, S3, N1 and N2 arranged in the circumferential direction. Such magnet roller 73 generates a magnetic field that enables developer to be borne on the developing sleeve 70 and generates a magnetic field that enables developer to be released from the developing sleeve 70 at a releasing area.

The developer on the developing sleeve 70 is raised in a bristle state at the development area Ar by the rotation of the developing sleeve 70 and forms a magnetic brush. The magnetic brush comes into contact with the photosensitive drum 3 rotated in the same direction as the developing sleeve 70 at the development area Ar, by which the electrostatic image on the photosensitive drum 3 is developed as toner image by charged toner. Further, developing bias voltage in which DC voltage and AC voltage are superposed is normally applied from a developing bias power supply to the developing sleeve 70 to enhance developing efficiency, that is, application rate of toner to the latent image. The developer remaining on the developing sleeve 70 after supplying toner to the photosensitive drum 3 is collected in the developing chamber 62 by further rotation of the developing sleeve 70.

Further, as illustrated in FIG. 3, an inductance sensor, i.e., toner density detecting unit, 68 that detects information related to toner density of developer in the developer container 60 is provided in the developer container 60, as illustrated in FIG. 3. In the present embodiment, the inductance sensor 68 is provided at a downstream side of the agitating chamber 63 in the developer conveyance direction.

Second Conveyance Screw

Figure 4:
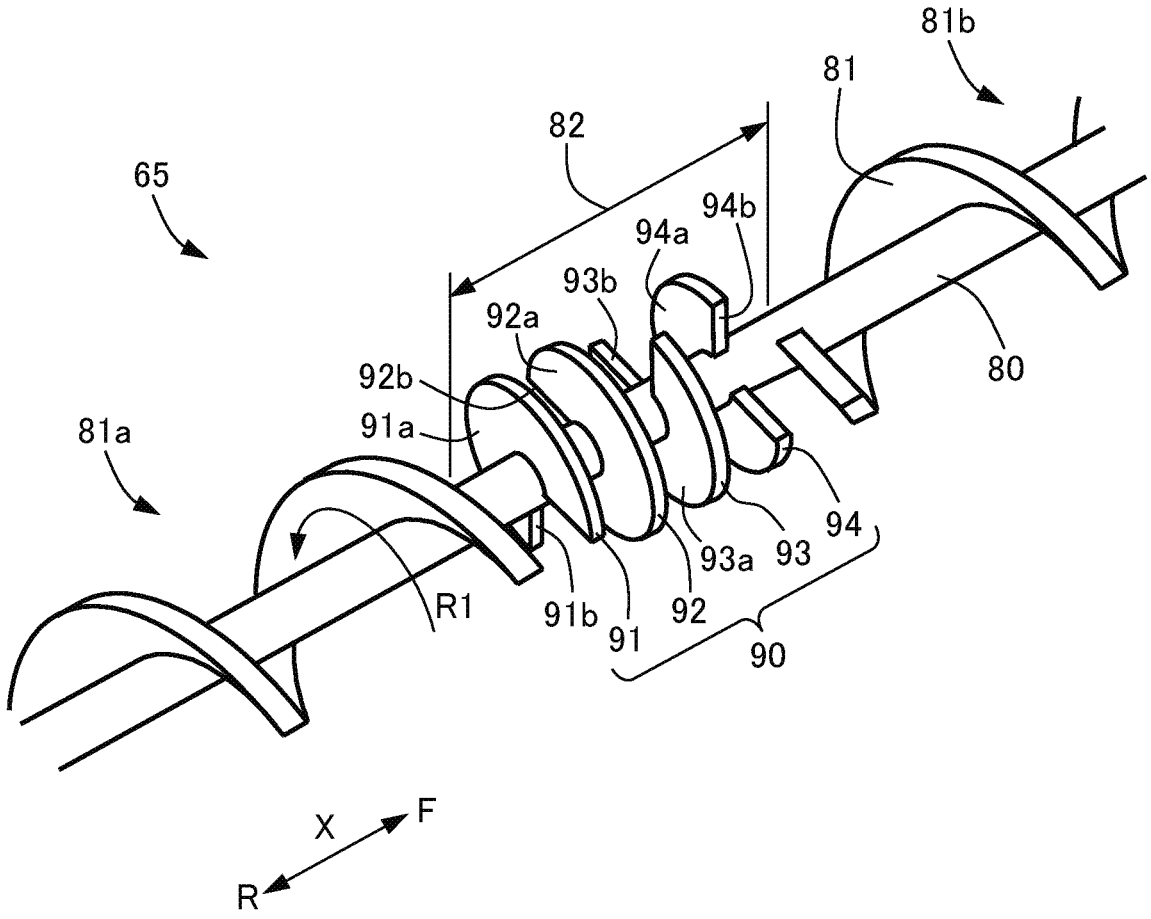
FIG. 4 is a perspective view of an agitating portion of a second conveyance screw according to the first embodiment.
Figure 5:
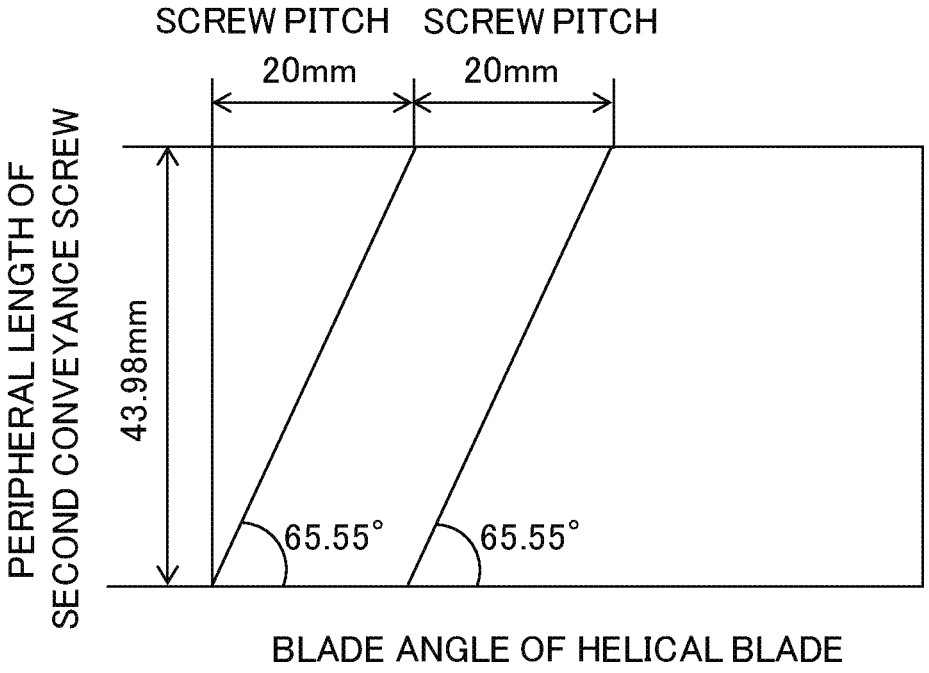
FIG. 5 is a graph illustrating a relationship between blade angle and peripheral length of a conveyance screw according to the first embodiment.

Next, a detailed configuration of the second conveyance screw 65 will be described with reference to FIGS. 3 and 4. The second conveyance screw 65 includes a shaft portion 80, a helical blade 81 having a helical shape and an agitating portion 90. In the present embodiment, the second conveyance screw 65 is formed by injection molding a plastic material. In the present embodiment, a helical blade 81 may be formed as one row of blade having an outer diameter of 14 mm and a pitch of 20 mm. Therefore, an angle of the helical blade 81 calculated based on peripheral length (43.98 mm) and pitch (screw pitch) of the helical blade 81 is 65.55° (refer to FIG. 5). In this example, the outer diameter of the second conveyance screw 65 is set to 14 mm and the pitch thereof is set to 20 mm, but the outer diameter and the pitch can be set to other dimensions as long as the angle of one cycle of the helical blade 81 is set to 80° or smaller to enable toner to be conveyed smoothly. In the present embodiment, an example has been described where the number of rows of the helical blade 81 is one, but the present disclosure is not limited to this example, and the number of rows can be two or more.

The helical blade 81 includes a first blade portion 81*a* having a helical shape, and a second blade portion 81*b* provided downstream of the first blade portion 81*a* in the front direction F and having a helical shape of a same turn direction as the first blade portion 81*a*. The helical blade 81 includes a gap portion 82 which is a gap formed on the helical blade 81 to make the blade discontinuous by having a length corresponding to one pitch removed, which is 20 mm. The gap portion 82 is provided between the first blade portion 81*a* and the second blade portion 81*b* in the front direction F. In the present embodiment, the length of the gap portion 82 is set to the length corresponding to one pitch, that is, 20 mm, but the present disclosure is not limited thereto, and the length can be longer than or shorter than the length corresponding to one pitch.

The agitating portion 90 is provided on the gap portion 82 and includes a first agitating plate, i.e., a first agitating portion, 91, a second agitating plate, i.e., a second agitating portion, 92, a third agitating plate, i.e., a third agitating portion, 93 and a fourth agitating plate, i.e., a fourth agitating portion, 94 provided in the named order toward the front direction F serving as a plurality of agitating plates, that is, agitating members. That is, the second agitating portion 92 is arranged downstream and adjacent to the first agitating portion 91 in the front direction F. Four agitating plates 91 to 94 are provided in the present embodiment, but the present disclosure is not limited thereto, and the number can be two or more, preferably two to four. If there are three agitating plates 91 to 94, the agitating property is reduced compared to the case where there are four agitating plates 91 to 94, but the conveyance property is increased. Similarly, if there are two agitating plates 91 to 94, the agitating property is deteriorated compared to the case where there are three agitating plates 91 to 94, but the conveyance property is increased. Therefore, three agitating plates 91 to 94 are most preferable from the viewpoint of balance between conveyance property and agitating property.

Each agitating plate 91 to 94 is a plate-shaped member arranged to intersect the rotational axis direction of the second conveyance screw 65 and aligned at equal distances within the gap portion 82. In the present embodiment, each agitating plate 91 to 94 is arranged orthogonal to the rotational axis of the shaft portion 80. The angle at which each agitating plate 91 to 94 is provided on the second conveyance screw 65 in the rotational axis direction is not limited to 90°, and can be determined arbitrarily, but the angle should be preferably set to 70° or more and 90° or less. Thereby, the agitating efficiency can be enhanced with the conveyance property maintained.

Each agitating plate 91 to 94 has an equivalent outer diameter as the outer diameter of the second conveyance screw 65 and a thickness of 1 mm. However, the outer diameter of each the agitating plate 91 to 94 is not limited to an outer diameter equivalent to the outer diameter of the helical blade 81, and for example, it may have an outer diameter smaller than the outer diameter of the helical blade 81. This arrangement enables to prevent the outer circumferential edge of each agitating plate 91 to 94 from being in contact with the inner circumferential surface of the agitating chamber 63. Further, the thickness of each agitating plate 91 to 94 is not limited to 1 mm, and it can be less than 1 mm or more than 1 mm. For example, if the thickness is more than 1 mm, the shape of the agitating plate may become block-shaped or rod-shaped instead of plate-shaped from the viewpoint of ratio to the outer diameter, and such shapes can also be adopted.

The agitating plates 91 to 94 include wall surfaces, i.e., wall portions, 91*a* to 94*a* that face the rear direction R and notched portions, i.e., recessed portions, 91*b* to 94*b* having a shape in which a portion of the periphery of the wall surfaces 91*a* to 94*a* is notched. The wall surfaces 91*a* to 94*a* are orthogonal to the rotational axis of the second conveyance screw 65. The notched portions 91*b* to 94*b* take the shape of a fan with a center thereof set at the rotational axis of the second conveyance screw 65. In the present embodiment, a central angle of the fan shape of the notched portions 91*b* to 94*b* is set to 90°. However, the central angle of the fan shape of the notched portions 91*b* to 94*b* is not limited to 90°, and it can be set to any angle, preferably 180° or less.

The notched portions 91*b* to 94*b* of the agitating plates 91 to 94 are each arranged so that their phases are shifted every 90° in a rotational direction R1 of the second conveyance screw 65. Shifting of phase of the notched portions according to the present embodiment means that the positions of notched portions of agitating plates do not correspond with those of adjacent plates in the circumferential direction around the center of rotation when the second conveyance screw 65 is viewed from the axial direction.

In the present embodiment, the adjacent notched portion 92*b* positioned downstream of the notched portion 91*b* arranged most upstream with respect to the front direction F which is the toner conveyance direction is shifted for 90° in a direction opposite to the rotational direction R1 of the second conveyance screw 65. Further, the notched portion 93*b* positioned downstream of the notched portion 92*b* with respect to the front direction F which is the toner conveyance direction is shifted for 90° in the direction opposite to the rotational direction R1 of the second conveyance screw 65. Further, the notched portion 94*b* positioned downstream of the notched portion 93*b* with respect to the front direction F which is the toner conveyance direction is shifted for 90° in the direction opposite to the rotational direction R1 of the second conveyance screw 65. As described, the notched portions 91*b* to 94*b* of at least one of the agitating plates 91 to 94 are arranged at a different position in the circumferential direction around the rotational axis of the second conveyance screw 65 from the adjacent notched portion. That is, the notched portion 91*b* of the first agitating portion 91 is arranged at a different position in the circumferential direction around the rotational axis of the second conveyance screw 65 with respect to the notched portion 92*b* of the second agitating portion 92. According to the present embodiment, the phases of notched portions 91*b* to 94*b* of the agitating plates 91 to 94 are each shifted for 90° in the rotational direction R1 of the second conveyance screw 65, but the present disclosure is not limited thereto, and the angle can be other than 90° or the phases can be matched. In another example, the angles in which the phases are shifted can be differed for each of the agitating plates 91 to 94.

Now, regarding the agitating plates 91 to 94, a volume ratio of a case where the plate has a circular shape without notched portions 91*b* to 94*b* is set to 100%. In the present embodiments, the agitating plates 91 to 94 have notched portions 91*b* to 94*b* of 90°, so that they each have a volume ratio of 75% with respect to the circular shape without the notched portions 91*b* to 94*b*. The space occupied by the notched portions 91*b* to 94*b* is 25% the volume ratio to the circular shape without the notched portions 91*b* to 94*b*. In the present embodiment, an example has been illustrated where the agitating plates 91 to 94 each have a volume ratio of 75% with respect to the circular shape without the notched portions 91*b* to 94*b*, but the present disclosure is not limited thereto, and the volume ratio can be set approximately between 60 and 90%. It is not preferable to set the volume ratio of each agitating plate 91 to 94 to exceed 90% to the circular shape without the notched portions 91*b* to 94*b* or to not provide the notched portions 91*b* to 94*b*, since the agitating efficiency of developer will be deteriorated significantly. It is not preferable to set the volume ratio of each agitating plate 91 to 94 to below 60% with respect to the circular shape without the notched portions 91*b* to 94*b*, since the conveyance property of developer will be lowered significantly.

The agitating portion 90 is arranged approximately at a center portion of the second conveyance screw 65, as illustrated in FIG. 3. However, the present disclosure is not limited thereto, and the agitating portion 90 should merely be arranged toward the front direction F from an upstream end portion of the second communicating port 61*b* in the second direction, that is, an end portion of the second communicating port 61*b* in the rear direction R, and toward the rear direction R from a downstream end portion of the first communicating port 61*a* in the second direction, that is, an end portion of the first communicating port 61*a* in the front direction F. Thereby, the agitating portion 90 is provided within the circulation path of the toner in the agitating chamber 63, so that the toner being circulated can be agitated effectively.

In the present embodiment, the inductance sensor 68 is arranged at the side portion in a front direction F of the agitating chamber 63, so that the agitating portion 90 can be arranged upstream of the inductance sensor 68 in the front direction F by arranging at an approximate center portion of the second conveyance screw 65. Thereby, even in a case where more toner is retained at a position toward the rear direction R of the agitating portion 90 than toward the front direction F, it becomes possible to suppress the influence on detection accuracy of the inductance sensor 68.

Next, an operation of conveying toner to the front direction F by rotating the second conveyance screw 65 will be described in detail with reference to FIGS. 3 and 4. As illustrated in FIG. 3, developer flowing into the agitating chamber 63 from the second communicating port 61*b* or toner supplied from the developer replenishment port 66 is conveyed in the front direction F within the agitating chamber 63 by rotation of the second conveyance screw 65. The developer conveyed by the helical blade 81 and having reached the agitating portion 90 abuts against and is baffled by the wall surface 91*a* of the agitating plate 91 on the rearmost direction R before passing through the notched portion 91*b* thereof toward the front direction F, and then abuts against and is baffled by the wall surface 92*a* of the adjacent agitating plate 92. Simultaneously, by rotation of the second conveyance screw 65, the developer passing through the notched portion 91*b* is agitated by the notched portion 91*b* in a sheared manner in the circumferential direction. The developer passing through the notched portion 91*b* is obstructed by the wall surface 92*a* of the adjacent agitating plate 92 and retained without being conveyed speedily, so that it is efficiently agitated in a sheared manner in the circumferential direction.

Similarly, the developer passing through the notched portion 92*b* is baffled by the wall surface 93*a* of the adjacent agitating plate 93 and agitated in a sheared manner in the circumferential direction. Further, the developer passing through the notched portion 93*b* is baffled by the wall surface 94*a* of the adjacent agitating plate 94 and agitated in a sheared manner in the circumferential direction. The developer having passed through the notched portion 94*b* is conveyed in the front direction F within the agitating chamber 63 by the rotation of the second conveyance screw 65 and reaches the inductance sensor 68. Thereby, the agitating property can be improved significantly.

That is, the developer passes through the notched portions 91*b* to 94*b* of the respective agitating plates 91 to 94 without moving over the agitating plates 91 to 94, and the developer is further agitated by the notched portions 91*b* to 94*b* in the direction of rotation of the second conveyance screw 65, by which the agitating efficiency is enhanced. Accordingly, the problem of having to agitate the replenished toner efficiently to a small amount of developer can be solved by having developer retained by the agitating plates 91 to 94 and having the notched portions 91*b* to 94*b* respectively formed on the agitating plates 91 to 94 agitate the developer at the retained portion.

The developer is temporarily baffled by the respective agitating plates 91 to 94 in the agitating portion 90, so that the conveyance property is reduced compared to the areas other than the agitating portion 90 of the second conveyance screw 65. Therefore, heights of the developer surface differ on the front and rear sides of the agitating portion 90 in the agitating chamber 63. For example, the height of the developer surface approximately corresponds to the shaft portion 80 of the second conveyance screw 65 at the front direction F of the agitating portion 90, while the height of the developer surface is higher than the shaft portion 80 at the rear direction R of the agitating portion 90.

As described, according to the image forming apparatus 1 of the present embodiment, the agitating plates 91 to 94 of the second conveyance screw 65 include the wall surfaces 91*a* to 94*a* and the notched portions 91*b* to 94*b*. Therefore, the developer conveyed by the second conveyance screw 65 abuts against and is baffled by the wall surfaces 91*a* to 94*a* and agitated in a sheared manner by the notched portions 91*b* to 94*b*. Therefore, the agitating property can be improved compared to a case where the developer is conveyed by the second conveyance screw 65 without being baffled at the agitating portion 90. Further according to the image forming apparatus 1 of the present embodiment, the agitating plates 91 to 94 are arranged at a position opposed to a portion of the area from the end portion of the second communicating port 61*b* in the rear direction R to the end portion of the first communicating port 61*a* in the front direction F. Since the agitating portion 90 is provided within the circulation path of toner in the agitating chamber 63, toner being conveyed in a circulated manner can be agitated effectively. Therefore, according to the image forming apparatus 1 of the present embodiment, a high agitating property can be achieved with the conveyance property maintained even if there is only a small amount of developer.

That is, according to the image forming apparatus 1 of the present embodiment, the second conveyance screw 65 not only agitates developer uniformly at the whole conveyance area but also agitates developer locally at the agitating portion 90 more significantly than the uniform agitation performed throughout the whole conveyance area. Further, the agitating plates 91 to 94 not only baffle the flow of developer in the conveyance direction locally at the wall surfaces 91*a* to 94*a* but also significantly improves the agitating efficiency by the notched portions 91*b* to 94*b*.

According further to the image forming apparatus 1 of the present embodiment, the notched portions 91*b* to 94*b* of the agitating plates 91 to 94 each have phases shifted for 90° in the rotational direction R1 of the second conveyance screw 65. Therefore, for example, the conveyance of developer passing through the notched portion 91*b* is obstructed by the wall surface 92*a* of the adjacent agitating plate 92 and the developer is retained without being conveyed speedily, so that it is efficiently agitated in a sheared manner in the circumferential direction, the same being performed at other notched portions 92*b* to 94*b*. Thereby, the agitating property can be improved significantly throughout the whole agitating portion 90.

According to the image forming apparatus 1 of the present embodiment, the agitating portion 90 is arranged on the rear direction R of the position opposed to the inductance sensor 68. Therefore, even in a case where more toner is retained at a position toward the rear direction R of the agitating portion 90 than at the front direction F, it becomes possible to suppress the influence on detection accuracy of the inductance sensor 68.

The image forming apparatus 1 of the present embodiment described above has been illustrated of a case having four agitating plates 91 to 94, the notched portions 91*b* to 94*b* of which take the shape of a fan with a central angle of 90° and each phase thereof being shifted for 90° in the rotational direction R1, but the present disclosure is not limited to this example. For example, the number of agitating plates can be three instead of four, and in that case, the notched portions on the agitating plates take the shape of a fan with a central angle of 120°, and the phases thereof are each shifted for 120° in the rotational direction R1. Even according to this example, the developer conveyed by the second conveyance screw 65 abuts against and is baffled by the wall surface and agitated in a sheared manner by the notched portions, so that the agitating property can be improved.

Second Embodiment

Next, a second embodiment of the present disclosure will be described in detail with reference to FIG. 6. The present embodiment differs from the configuration of the first embodiment in that agitating plates 191 to 194 are formed in the shape of a cross with a center thereof corresponding to a rotational axis of a second conveyance screw 165. The other configurations are similar to the first embodiment, so that they are denoted with the same reference numbers and detailed descriptions thereof are omitted.

Figure 6:
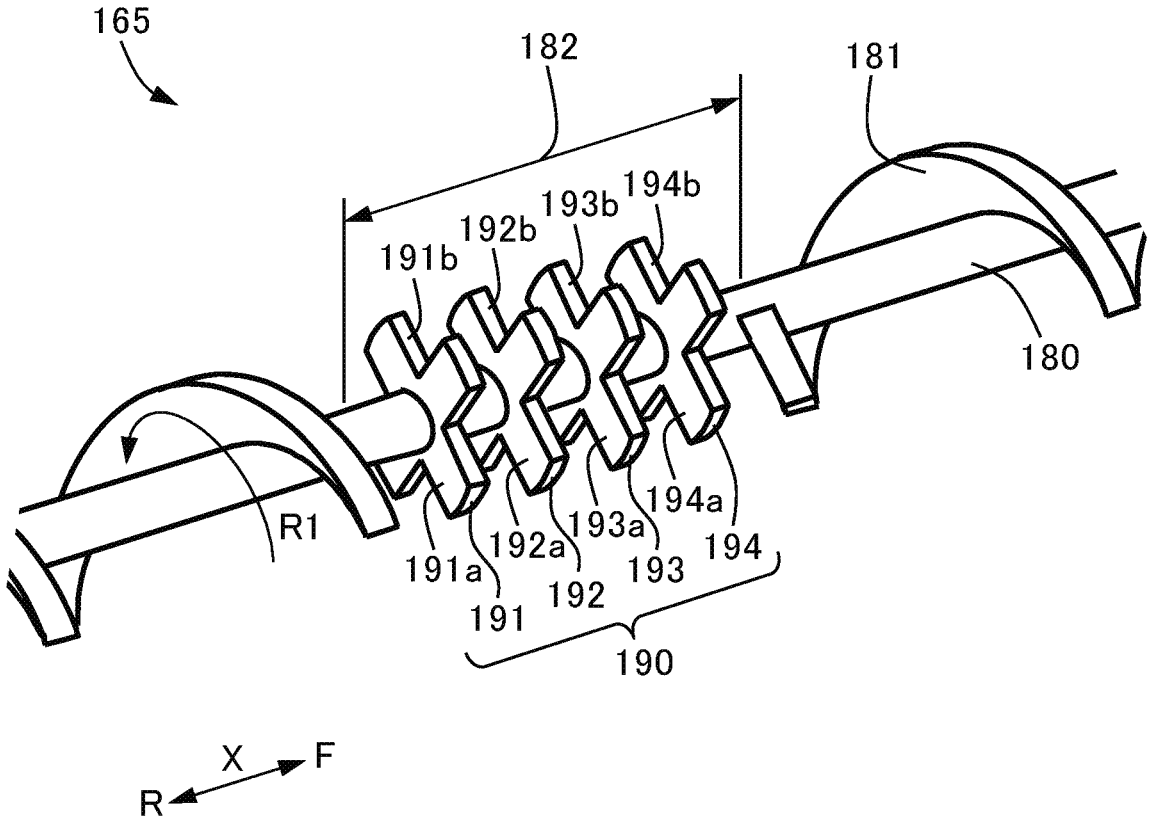
FIG. 6 is a perspective view of an agitating portion of a second conveyance screw according to a second embodiment.

In the present embodiment, the second conveyance screw 165 includes a shaft portion 180, a helical blade, i.e., blade, 181 having a helical shape and an agitating portion 190, as illustrated in FIG. 6. The agitating portion 190 is provided at a gap portion 182 and includes a plurality of agitating plates, i.e., agitating members, 191, 192, 193 and 194. The agitating plates 191 to 194 respectively include wall surfaces, i.e., wall portions, 191*a* to 194*a* facing the rear direction R and notched portions, i.e., recessed portions, 191*b* to 194*b* having a shape in which a portion of a periphery of the wall surfaces 191*a* to 194*a* is notched. The wall surfaces 191*a* to 194*a* are orthogonal to the rotational axis of the second conveyance screw 165. The agitating plates 191 to 194 are approximately cross shaped when viewed from the cross-sectional direction, protruding from the rotation shaft toward the outer diameter direction and has four blades arranged every 90° in the rotational direction R1. In the agitating plates 191 to 194, the portions between the blades serve as the notched portions 191*b* to 194*b*.

Each agitating plate 191 to 194 has a height up to a height equivalent to the outer diameter of the second conveyance screw 165 and a thickness of 1 mm. The agitating plates 191 to 194 are allocated in four areas in the axial direction of the second conveyance screw 165 within a gap portion 182 having a 20 mm length in the conveyance direction. The agitating plates 191 to 194 are arranged in an aligned manner without shifting phases of the notched portions 191*b* to 194*b* with respect to the rotational direction R1 of the second conveyance screw 165. According to the present embodiment, the phases of the notched portions 191*b* to 194*b* are not shifted and are aligned in the conveyance direction, but the present disclosure is not limited thereto, and the phases can be shifted in appropriate angles as according to the first embodiment.

Now, regarding the agitating plates 191 to 194, a volume ratio of a case where the plate has a circular shape without notched portions 191*b* to 194*b* is set to 100%. In the present embodiments, each agitating plate 191 to 194 has four notched portions 191*b* to 194*b*, so that each plate has a volume ratio of 57.9% with respect to the circular shape without the notched portions 191*b* to 194*b*. In the present embodiment, similar to the first embodiment, the volume ratio of the agitating plates 191 to 194 can be set approximately between 60 and 90%, for example. Further, the number of blades, in other words, the number of notched portions provided on each of the agitating plates 191 to 194 is not limited to four and can be set to a number between two and six, for example. Furthermore, the arrangement of blades on each of the agitating plates 191 to 194 is not necessary set at equal distances and can be set at appropriate distances.

As described, according to the image forming apparatus 1 of the present embodiment, the agitating plates 191 to 194 of the second conveyance screw 165 are respectively provided with wall surfaces 191*a* to 194*a* and notched portions 191*b* to 194*b*. Therefore, the developer conveyed by the second conveyance screw 165 abuts against and is baffled by the wall surfaces 191*a* to 194*a* and agitated in a sheared manner by the notched portions 191*b* to 194*b*. Therefore, the agitating property can be improved compared to a case where the developer is conveyed by the second conveyance screw 165 without being baffled at the agitating portion 190. Further according to the image forming apparatus 1 of the present embodiment, the agitating plates 191 to 194 are arranged at a position opposed to a portion of the area from the end portion of the second communicating port 61*b* in the rear direction R to the end portion of the first communicating port 61*a* in the front direction F. Since the agitating portion 190 is provided within the circulation path of toner in the agitating chamber 63, toner being conveyed in a circulated manner can be agitated effectively. Therefore, according to the image forming apparatus 1 of the present embodiment, a high agitating property can be achieved with the conveyance property maintained even if there is only a small amount of developer.

Third Embodiment

Next, a third embodiment of the present disclosure will be described in detail with reference to FIGS. 7 and 8. The present embodiment differs from the configuration of the first embodiment in that a third blade portion 283 is used instead of the agitating portion 90 or 190 in a second conveyance screw 265. The other configurations are similar to the first embodiment, so that they are denoted with the same reference numbers and detailed descriptions thereof are omitted.

Second Conveyance Screw

A detailed configuration of the second conveyance screw 265 will be described with reference to FIGS. 7 and 8. The second conveyance screw 265 includes a shaft portion 280, and a first blade portion 281, a second blade portion 282 and the third blade portion 283 which all have a helical shape. In the present embodiment, the second conveyance screw 265 is formed by injection molding a plastic material. The second blade portion 282 has a helical shape of the same direction and same pitch as the first blade portion 281. The first blade portion 281 and the second blade portion 282 are each formed as one row of blade, for example, having an outer diameter of 14 mm and a pitch of 20 mm. Therefore, an angle of the first blade portion 281 calculated based on peripheral length (43.98 mm) and pitch (screw pitch) of the first and second blade portions 281 and 282 is 65.55° (refer to FIG. 5). In this example, the outer diameter of the first and second blade portions 281 and 282 is set to 14 mm and the pitch thereof is set to 20 mm, but the outer diameter and the pitch can be set to other dimensions as long as the angle of one cycle of the helical blade is set to 80° or smaller to enable toner to be conveyed smoothly. In the present embodiment, an example has been illustrated where the number of rows of the first and second blade portions 281 and 282 is one, but the present disclosure is not limited to this example, and the number of rows can be two or more.

The third blade portion 283 is provided continuously between the first blade portion 281 and the second blade portion 282, having a helical shape in the same direction as the first blade portion 281 and the second blade portion 282 and having a narrower pitch. The total length of the third blade portion 283 in the longitudinal direction X of the second conveyance screw 265 is set to a length corresponding to one pitch of the first blade portion 281 and the second blade portion 282, that is, 20 mm. In the present embodiment, the total length of the third blade portion 283 is set to a length corresponding to one pitch of the first blade portion 281 and the second blade portion 282, that is, 20 mm, but the present disclosure is not limited thereto, and the total length can be longer than the length corresponding to one pitch or shorter than one pitch. According further to the present embodiment, an example has been described of a case where the third blade portion 283 is disposed continuously between the first blade portion 281 and the second blade portion 282, but the present disclosure is not limited thereto, and the third blade portion 283 can be provided with a gap formed between the first blade portion 281 and the second blade portion 282.

The third blade portion 283 can be formed as one row of blade, for example, having an outer diameter of 14 mm and a pitch of 5 mm. Therefore, the third blade portion 283 is formed to have four turns with a pitch of 5 mm in an area corresponding to one pitch of the first blade portion 281 and the second blade portion 282 formed of a blade having a helical shape, that is, in a range of 20 mm. In the present embodiment, the number of turns of the third blade portion 283 is set to four in the length corresponding to one pitch of the first blade portion 281 and the second blade portion 282, but the present disclosure is not limited thereto. The third blade portion 283 should merely have a helical shape in the same direction and with a narrower pitch than the first blade portion 281 and the second blade portion 282. Therefore, the number of turns of the third blade portion 283 within the length corresponding to one pitch of the first blade portion 281 and the second blade portion 282 should merely exceed one, and preferably be between two and four. In a case where the number of turns of the third blade portion 283 is three, the agitating property becomes lower and the conveyance property becomes higher compared to the case where the number of turns of the third blade portion 283 is four. Similarly, if the number of turns of the third blade portion 283 is two, the agitating property becomes lower and the conveyance property becomes higher compared to the case where the number of turns of the third blade portion 283 is three. Therefore, the number of turns of the third blade portion 283 should most preferably be three from the viewpoint of balance of conveyance property and agitating property.

The third blade portion 283 has an outer diameter equivalent to the outer diameter of the first blade portion 281 and the second blade portion 282. However, the outer diameter of the third blade portion 283 is not limited to the outer diameter equivalent to the outer diameter of the first blade portion 281 and the second blade portion 282, and for example, the outer diameter can be equal to or smaller than the outer diameter of the first and second blade portions 281 and 282. Thereby, it becomes possible to prevent the outer circumferential edge of the third blade portion 283 from being in contact with the inner circumferential surface of the agitating chamber 63.

The third blade portion 283 includes a wall surface 283*a* facing the rear direction R of a conveyance wall and notched portions 283*b* having a shape in which a portion of a periphery of the conveyance wall is notched. Each notched portion 283*b* has a length of 4 mm in the circumferential direction and a depth of 4 mm in the radial direction. The depth of 4 mm in the radial direction is set to approximately ½ the height of the conveyance wall. A case where the length of the notched portion 283*b* is set to 4 mm and the depth thereof set to 4 mm is described in the present embodiment, but the present disclosure is not limited thereto, and other dimensions can be adopted. Moreover, the dimensions can be varied for each notched portion 283*b*, for example.

The notched portions 283*b* of the third blade portion 283 are provided every 90° in the rotational direction R1 on the second conveyance screw 265. Therefore, the phases of adjacent notched portions 283*b* are set to correspond in the longitudinal direction X. A state in which the phases of the notched portions 283*b* correspond refers to a state in which the positions of the notched portions 283*b* adjacent one another in the longitudinal direction X correspond when the second conveyance screw 265 is viewed in the longitudinal direction X. That is, in a state where the second conveyance screw 265 is viewed in the rotational axis direction, at least a portion of the notched portion, i.e., recessed portions, (such as 291*b*) is overlapped with another notched portion (such as 292*b*) adjacent thereto in the front direction F.

In the present embodiment, the notched portions 283*b* are provided every 90° in the rotational direction R1 of the second conveyance screw 265, but the present disclosure is not limited thereto, and the notched portions can be provided at angles other than every 90°, such as every 120°. Even further, the notched portions 283*b* can be provided per an angle indivisible of 360°, such as every 100°. In that case, the notched portion 283*b* is arranged at a different position in the rotational direction R1 with respect to another notched portion 283*b* adjacent thereto in the front direction F and with the phases shifted. Further, the angle of each notched portion 283*b* can be varied from the angle of the notched portion 283*b* adjacent thereto in the rotational direction R1 (refer to the imaginary line of FIG. 8). In that case, when the second conveyance screw 265 is viewed in the rotational axis direction, the notched portion is not superposed with other notched portions formed on the third blade portion 283 adjacent thereto in the front direction F.

Now, regarding the third blade portion 283, a volume ratio of the conveyance wall per pitch of a case where there are no notched portions 283*b* is set to 100%. In that case, the volume ratio of the third blade portion 283 is set to 86.2% and the volume ratio of the space occupied by the notched portions 283*b* is 13.8%. The present embodiment has been described based on a case where the third blade portion 283 has a volume ratio of 86.2% with respect to a case without the notched portions 283*b*, but the present disclosure is not limited thereto, and the dimension or the arrangement of the notched portions 283*b* can be changed to realize a volume ratio of 70 to 90%. If the volume ratio of the third blade portion 283 is set to exceed 90% of a case where notched portions 283*b* are not provided or if the third blade portion 283 is provided without notched portions 283*b*, the agitating efficiency of developer will be significantly deteriorated and therefore not preferable. Further, if the volume ratio of the third blade portion 283 is set to fall below 70% of the case where notched portions 283*b* are not provided, the conveyance property of developer will be significantly deteriorated and therefore not preferable.

Figure 7:
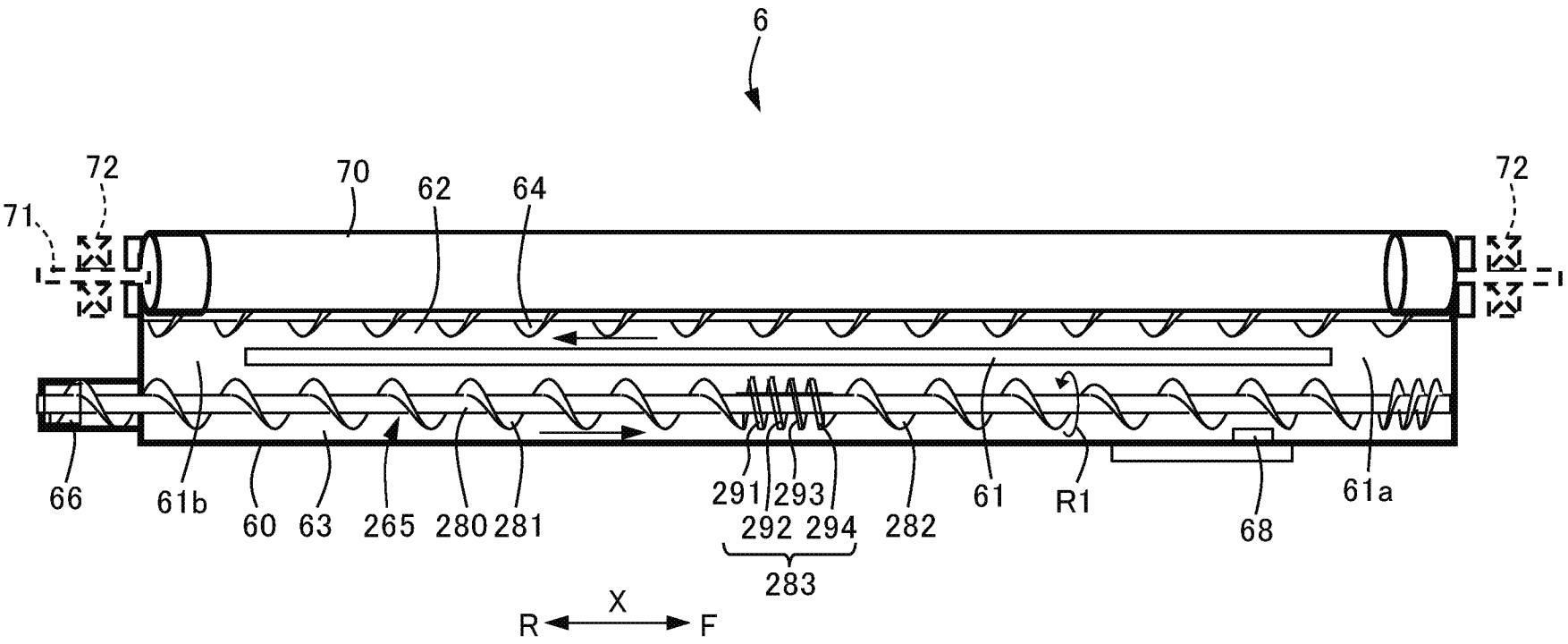
FIG. 7 is a vertical cross-sectional view of a developing apparatus according to a third embodiment.
Figure 8:
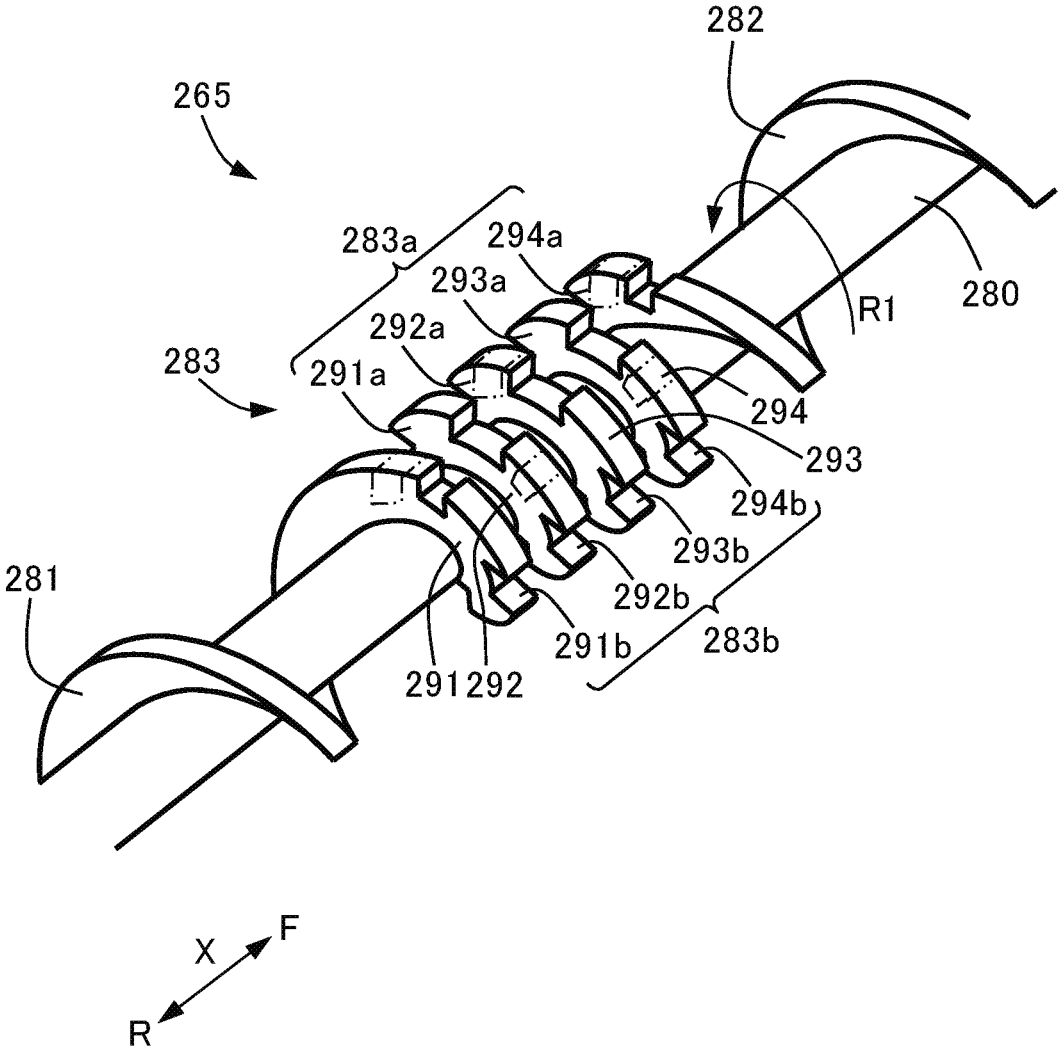
FIG. 8 is a perspective view of a third blade portion of a second conveyance screw according to the third embodiment.

The third blade portion 283 is arranged approximately at a center portion of the second conveyance screw 265, as illustrated in FIG. 7. However, the present disclosure is not limited thereto, and the third blade portion 283 should preferably be arranged at a position opposed to a portion of a range from an end portion at a rear direction R of the second communicating port 61*b* to an end portion at a front direction F of the first communicating port 61*a*. Thereby, the third blade portion 283 is provided within the circulation path of toner in the agitating chamber 63, so that circulated toner can be agitated effectively.

In the present embodiment, the inductance sensor 68 is arranged at the side portion in the front direction F of the agitating chamber 63, so that the third blade portion 283 can be arranged upstream of the inductance sensor 68 in the front direction F by being arranged at an approximate center portion of the second conveyance screw 265. Thereby, even in a case where more toner is retained at a position toward the rear direction R of the third blade portion 283 than at the front direction F, it becomes possible to suppress the influence on detection accuracy of the inductance sensor 68.

Next, an operation of a case where the second conveyance screw 265 is rotated to convey the toner to the front direction F will be described in detail with respect to FIGS. 7 and 8. According to the present embodiment, the third blade portion 283 has four turns, so that for sake of description, the third blade portion 283 is defined to include a first turn 291, a second turn 292, a third turn 293 and a fourth turn 294 arranged in the named order from the side of the rear direction R toward the side of the front direction F. That is, the first turn 291 corresponds to one turn positioned at the rearmost direction R, and the second turn 292 corresponds to one turn adjacent to the first turn 291 in the front direction F. The third turn 293 corresponds to one turn adjacent to the second turn 292 in the front direction F, and the fourth turn 294 corresponds to one turn adjacent to the third turn 293 in the front direction F. The wall surface 283*a* includes a wall surface 291*a* of the first turn 291, a wall surface 292*a* of the second turn 292, a wall surface 293*a* of the third turn 293 and a wall surface 294*a* of the fourth turn 294. Furthermore, the notched portions 283*b* include notched portions 291*b* of the first turn 291, notched portions 292*b* of the second turn 292, notched portions 293*b* of the third turn 293 and notched portions 294*b* of the fourth turn 294.

As illustrated in FIG. 7, developer flowing into the agitating chamber 63 from the second communicating port 61*b* or toner supplied from the developer replenishment port 66 is conveyed toward the front direction F within the agitating chamber 63 by rotation of the second conveyance screw 265. The conveyance speed of developer conveyed by the first blade portion 281 and reaching the third blade portion 283 is reduced by the narrowed pitch, and the portion of developer not conveyed by the third blade portion 283 abuts against and is baffled by the wall surface 291*a* of the first turn 291. The developer baffled by the wall surface 291*a* passes through the notched portions 291*b* of the first turn 291 toward the front direction F, but thereafter, abuts against and is baffled by the wall surface 292*a* adjacent to the wall surface 291*a* in the front direction F. At the same time, by rotation of the second conveyance screw 265, the developer passing through the notched portions 291*b* is agitated in a sheared manner by the notched portion 291*b* in the circumferential direction. The conveyance of developer passing through the notched portions 291*b* is obstructed by the wall surface 292*a* adjacent thereto in the front direction F and retained without being conveyed speedily, so that the developer is efficiently agitated in a sheared manner in the circumferential direction.

Similarly, the developer passing through the notched portions 292*b* is baffled by the wall surface 293*a* adjacent thereto in the front direction F and agitated in a sheared manner in the circumferential direction. Further, the developer passing through the notched portions 293*b* is baffled by the wall surface 294*a* adjacent thereto in the front direction F and agitated in a sheared manner in the circumferential direction. The developer having passed through the notched portions 294*b* is conveyed toward the front direction F within the agitating chamber 63 by the rotation of the second blade portion 282 and reaches the inductance sensor 68. Thereby, the agitating property can be improved significantly.

The developer passes through the notched portion 283*b* of the third blade portion 283 without moving over the third blade portion 283 and agitated by the notched portion 283*b* in the direction of rotation of the second conveyance screw 265, by which the agitating efficiency can be improved. Therefore, the problem to be solved of agitating the replenished toner efficiency to the small amount of developer can be solved by retaining developer by the third blade portion 283 and agitating developer at the retained portion by the notched portion 283*b* provided on the third blade portion 283.

In the third blade portion 283 having a narrower pitch than the first blade portion 281 and the second blade portion 282, the conveyance speed is reduced and the developer is temporarily baffled by the wall surface 283*a*, so that the conveyance property is deteriorated compared to the first blade portion 281 and the second blade portion 282. Therefore, in the agitating chamber 63, the height of the developer surface is varied before and after the third blade portion 283. For example, the developer surface at the second blade portion 282 on the front direction F of the third blade portion 283 approximately corresponds to the shaft portion 280 of the second conveyance screw 265, whereas the developer surface at the first blade portion 281 on the rear direction R of the third blade portion 283 is higher than the shaft portion 280.

According to the image forming apparatus 1 of the present embodiment as described above, the third blade portion 283 of the second conveyance screw 265 has a helical shape in the same direction as the first blade portion 281 and the second blade portion 282 but with a narrower pitch, with notched portions 283*b* formed on the periphery thereof. Therefore, when the developer conveyed by the second conveyance screw 265 reaches the third blade portion 283 from the first blade portion 281, conveyance speed of developer is reduced so that the developer abuts against and is baffled by the wall surface 283*a* and agitated in a sheared manner by the notched portions 283*b*. Thus, the agitating property can be improved compared to a case where the developer is not baffled at the third blade portion 283 and conveyed at a same conveyance speed as the first blade portion 281 and the second blade portion 282. Further according to the image forming apparatus 1 of the present embodiment, the third blade 283 is arranged at a position opposing to a portion of the area from the end portion of the second communicating port 61*b* in the rear direction R to the end portion of the first communicating port 61*a* in the front direction F. Since the third blade portion 283 is provided within the circulation path of toner in the agitating chamber 63, toner being conveyed in a circulated manner can be agitated effectively. Therefore, according to the image forming apparatus 1 of the present embodiment, a high agitating property can be achieved with the conveyance property maintained even if there is only a small amount of developer.

According to the image forming apparatus 1 of the present embodiment, the second conveyance screw 265 not only agitates developer uniformly at the whole conveyance area but also agitates developer locally at the third blade portion 283 more significantly than the uniform agitation performed throughout the whole conveyance area. Further, the third blade portion 283 not only baffles the flow of developer in the conveyance direction locally at the wall surface 283*a* but also significantly improves the agitating efficiency by the notched portions 283*b*.

According further to the image forming apparatus 1 of the present embodiment, the notched portions 283*b* of the third blade portion 283 are arranged every 90° in the rotational direction R1 of the second conveyance screw 265. The conveyance of developer passing through the notched portions 283*b* is obstructed by the wall surface 283*a* adjacent thereto in the front direction F and the developer is retained without being conveyed speedily, so that it is efficiently agitated in a sheared manner in the circumferential direction. Thereby, the agitating property can be improved significantly throughout the third blade portion 283.

According even further to the image forming apparatus 1 of the present embodiment, the third blade portion 283 is arranged on the rear direction R of the position opposed to the inductance sensor 68. Therefore, even in a case where more toner is retained at a position toward the rear direction R of the third blade portion 283 than at the front direction F, it becomes possible to suppress the influence on detection accuracy of the inductance sensor 68.

Fourth Embodiment

Next, a fourth embodiment of the present invention will be described in detail with reference to FIG. 9. The present embodiment differs from the configuration of the third embodiment in that a third blade portion 383 has a helical shape in the opposite direction as a first blade portion 381 and a second blade portion 382. The other configurations are similar to the first and third embodiments, so that they are denoted with the same reference numbers and detailed descriptions thereof are omitted.

Figure 9:
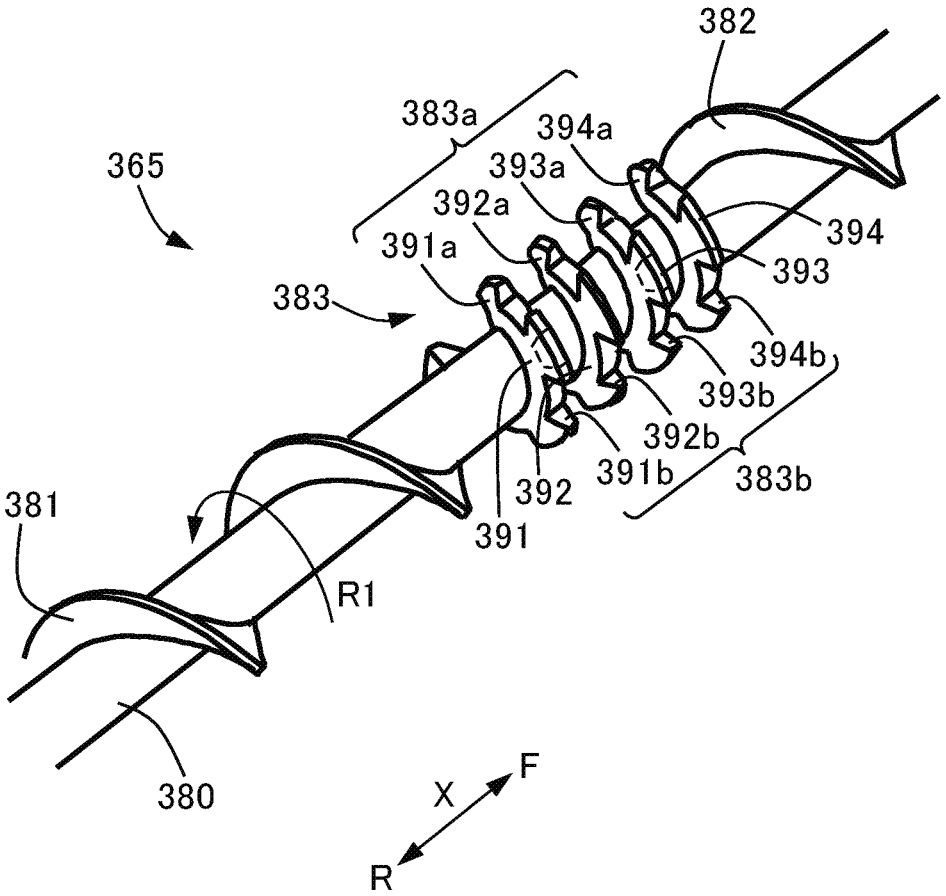
FIG. 9 is a perspective view of a third blade portion of a second conveyance screw according to a fourth embodiment.

According to the present embodiment, as illustrated in FIG. 9, a second conveyance screw 365 includes a shaft portion 380, and a first blade portion 381, a second blade portion 382 and a third blade portion 383 which all have helical shapes. The third blade portion 383 is disposed continuously between the first blade portion 381 and the second blade portion 382 and has a helical shape in the opposite direction as the first blade portion 381 and the second blade portion 382. The third blade portion 383 can be formed as one row of blade, for example, having an outer diameter of 14 mm which is equivalent to the first and second blade portions 381 and 382 and a narrower pitch of 5 mm. Therefore, the third blade portion 383 is formed to have four turns with a pitch of 5 mm in an area corresponding to one pitch of the first blade portion 381 and the second blade portion 382 formed of a blade having a helical shape, that is, in an area of 20 mm. The present embodiment has been described of a case where the third blade portion 383 is disposed continuously between the first blade portion 381 and the second blade portion 382, but the present disclosure is not limited thereto, and the third blade portion 383 can be provided with a gap formed between the first blade portion 381 and the second blade portion 382.

According to the present embodiment, the number of turns of the third blade portion 383 is set to four in a length corresponding to one pitch of the first and second blade portions 381 and 382, but the present disclosure is not limited thereto. The pitch of the third blade portion 383 is not limited as long as the third blade portion 383 has a helical shape in a direction opposite to the first and second blade portions 381 and 382. Therefore, the number of turns of the third blade portion 383 corresponding to the length of one pitch of the first and second blade portions 381 and 382 can of course be greater than one, but it can also be set to any value smaller than one. However, the number of turns of the third blade portion 383 with respect to the length corresponding to one pitch of the first and second blade portions 381 and 382 should preferably be between two and four, and most preferably be set to three from the viewpoint of balance of conveyance property and agitating property.

The third blade portion 383 includes wall surface 383*a* of the conveyance walls facing the rear direction R and notched portions 383*b* having a shape in which a portion of the periphery of the conveyance walls is notched. Each notched portion 383*b* has a length of 4 mm in the circumferential direction and a depth of 4 mm in the radial direction. The depth of 4 mm in the radial direction is set to approximately ½ the height of the conveyance wall. The notched portions 383*b* of the third blade portion 383 are provided every 90° in the rotational direction R1 of the second conveyance screw 365. Therefore, the phases of adjacent notched portions 383*b* correspond in the longitudinal direction X. In the present embodiment, the notched portions 383*b* are provided every 90° in the rotational direction R1 of the second conveyance screw 365, but the present disclosure is not limited thereto. For example, the angle of each notched portion 383*b* can be varied from the angle of the notched portion 383*b* adjacent thereto in the rotational direction R1 (refer to the broken line of FIG. 9). In that case, when the second conveyance screw 365 is viewed in the rotational axis direction, the notched portion is not superposed with other notched portions formed on the third blade portion 383 adjacent thereto in the front direction F.

Now, regarding the third blade portion 383, a volume ratio of a conveyance wall per pitch of a case without the notched portions 383*b* is set to 100%. In that case, the volume ratio of the third blade portion 383 is set to 86.2% and the volume ratio of the space occupied by the notched portions 383*b* is 13.8%. The present embodiment has been described of a case where the third blade portion 383 has a volume ratio of 86.2% with respect to a case without the notched portions 383*b*, but the present disclosure is not limited thereto, and the dimension or the arrangement of the notched portions

383*b* can be changed to realize a volume ratio of approximately 60 to 90%, for example. If the volume ratio of the third blade portion 383 is set to exceed 90% compared to a case where notched portions 383*b* are not provided or if the third blade portion 383 is provided without notched portions 383*b*, the agitating efficiency of developer will be significantly deteriorated and therefore not preferable. In that case, the conveyance property of developer by the third blade portion 383 to the rear direction R is increased, by which the conveyance property of the second conveyance screw 365 is significantly reduced, so that it is not preferable. Further, if the volume ratio of the third blade portion 383 is set to fall below 60% of the case where notched portions 383*b* are not provided, the conveyance property of developer will not be deteriorated and therefore not preferable.

Next, the operation of rotating the second conveyance screw 365 to convey the toner to the front direction F will be described in detail. The developer conveyed by the first blade portion 381 and reaching the third blade portion 383 is pushed back by the opposite direction of the turn. However, the third blade portion 383 is shorter than the first blade portion 381 and the first blade portion 381 has greater conveyance force, so that the developer is conveyed to the front direction F as a whole but the conveyance speed thereof is reduced. The developer having reached the third blade portion 383 abuts against and is baffled by a wall surface 391*a* of a first turn 391. The developer baffled by the wall surface 391*a* passes through notched portions, i.e., recessed portions, 391*b* of the first turn 391 to the front direction F, and thereafter abuts against and is baffled by a wall surface 392*a* adjacent thereto in the front direction F. At the same time, by rotation of the second conveyance screw 365, the developer passing through the notched portions 391*b* is agitated in a sheared manner in the circumferential direction by the notched portions 391*b*. As described, the conveyance of developer passing through the notched portions 391*b* is obstructed by the wall surface 392*a* adjacent thereto in the front direction F and the developer is retained without being conveyed speedily, so that the developer is agitated efficiently in a sheared manner in the circumferential direction.

Similarly, the developer passing through notched portions 392*b* is baffled by a wall surface 393*a* adjacent thereto in the front direction F and agitated in a sheared manner in the circumferential direction. Further, the developer passing through notched portions 393*b* is baffled by a wall surface 394*a* adjacent thereto in the front direction F and agitated in a sheared manner in the circumferential direction. Even further, the developer passing through notched portions 394*b* is agitated in a sheared manner in the circumferential direction. The developer having passed through the notched portions 394*b* is conveyed in the front direction F within the agitating chamber 63 by rotation of the second blade portion 382 and reaches the inductance sensor 68.

Before the developer passes through the third blade portion 383, a portion of the developer passes the notched portions 391*b* to 394*b* toward the front direction F and a portion of the developer is conveyed to the rear direction R along the wall surfaces 391*a* to 394*a* by the rotation of the third blade portion 383. As described, developer is conveyed in mixture in the front direction F and the rear direction R and agitated in a sheared manner in the circumferential direction while passing through the notched portions 391*b* to 394*b*, so that the agitating property can be improved significantly.

As described, according to the image forming apparatus 1 of the present embodiment, the third blade portion 383 of the second conveyance screw 365 has a helical shape turned in the opposite direction as the first and second blade portions 381 and 382 with a narrower pitch, with notched portions 383*b* formed on the periphery thereof. Therefore, developer conveyed by the second conveyance screw 365 from the first blade portion 381 and reaching the third blade portion 383 is subjected to force pushing back the developer, so that the developer abuts against and is baffled by the wall surface 383*a* and agitated in a sheared manner by the notched portions 383*b*. Therefore, the agitating property can be improved compared to a case where the developer is conveyed in a same conveyance speed as the first and second blade portions 381 and 382 without being baffled at the third blade portion 383. According further to the image forming apparatus 1 of the present embodiment, the third blade portion 383 is arranged at a position opposed to a portion of the area from the end portion of the second communicating port 61*b* in the rear direction R to the end portion of the first communicating port 61*a* in the front direction F. Therefore, the third blade portion 383 is provided in the circulation path of toner in the agitating chamber 63, and toner conveyed in a circulated manner can be agitated effectively. According to the image forming apparatus 1 of the present embodiment, a high agitating property can be achieved with the conveyance property maintained even if there is only a small amount of developer.

As described, according to the present invention, a high agitating property can be achieved with the conveying property maintained even in a case where there is a small amount of developer.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-106040, filed Jun. 6, 2019 and No. 2019-106041, filed Jun. 6, 2019 which are hereby incorporated by reference herein in their entirety.

What is claimed is:

1. A developing apparatus comprising:

a developer bearing member configured to bear developer containing toner and carrier and to rotate;

a first chamber configured to supply the developer to the developer bearing member;

a second chamber defined by a partition wall from the first chamber and configured to form a circulation path of the developer with the first chamber;

a first conveyance screw arranged in the first chamber and configured to convey the developer in a first direction;

a second conveyance screw arranged in the second chamber and configured to convey the developer in a second direction opposite to the first direction;

a first communication port configured to allow the developer to communicate from the second chamber to the first chamber;

a second communication port provided upstream of the first communication port in the second direction and configured to allow the developer to communicate from the first chamber to the second chamber; and a toner density detector arranged in the second chamber and configured to detect toner density of the developer in the circulation path, the toner density detector being arranged downstream in the second direction of an upstream end portion of the second communication port in the second direction and arranged upstream in the second direction of a downstream end portion of the first communication port in the second direction, wherein the second conveyance screw comprises a first blade portion having a helical shape, a second blade portion provided downstream of the first blade portion in the second direction and having a helical shape of a same turn direction as the first blade portion, a gap portion provided between the first blade portion and the second blade portion in the second direction, and a plurality of agitating portions provided in the gap portion, each of the plurality of agitating portions comprises a wall portion provided to intersect a rotational axis direction of the second conveyance screw and a recessed portion having a shape in which a portion of a periphery of the wall portion is recessed, and the plurality of agitating portions is arranged downstream in the second direction of the upstream end portion of the second communication port in the second direction and arranged upstream of the toner density detector in the second direction.

2. The developing apparatus according to claim 1, wherein the plurality of agitating portions comprises a first agitating portion and a second agitating portion arranged adjacent to and downstream of the first agitating portion in the second direction, and the recessed portion of the first agitating portion is arranged at a different position as the recessed portion of the second agitating portion in a circumferential direction around the rotational axis of the second conveyance screw.

3. The developing apparatus according to claim 1, wherein the plurality of agitating portions comprises an outer diameter which is equal to or smaller than an outer diameter of the first blade portion and the second blade portion, and the recessed portion comprises a fan shape, a center of the shape corresponding to the rotational axis of the second conveyance screw.

4. The developing apparatus according to claim 3, wherein a central angle of the fan shape of the recessed portion is 180° or less.

5. The developing apparatus according to claim 1, wherein the plurality of agitating portions comprises a cross-shape, a center of the shape corresponding to the rotational axis of the second conveyance screw.

6. The developing apparatus according to claim 1, wherein the wall portion of the plurality of agitating portions is intersected orthogonally with the rotational axis direction of the second conveyance screw.

7. The developing apparatus according to claim 1, wherein the gap portion comprises a length corresponding to one pitch of the first blade portion and the second blade portion.

8. The developing apparatus according to claim 1, wherein the plurality of agitating portions is two.

9. The developing apparatus according to claim 1, wherein the plurality of agitating portions is three.

10. The developing apparatus according to claim 1, wherein the plurality of agitating portions is four.

* * * * *